United States Patent [19]

Rahmfeld et al.

[11] 4,227,636

[45] Oct. 14, 1980

[54] SUPPORTING ROLLER STAND FOR STEEL SLAB STRAND CASTING PLANTS, PARTICULARLY FOR CURVED SLAB STRAND CASTING PLANTS

[75] Inventors: Werner Rahmfeld, Mulheim; Dieter Kothe, Moers, both of Fed. Rep. of Germany

[73] Assignee: Demag A.G., Fed. Rep. of Germany

[21] Appl. No.: 727,573

[22] Filed: Sep. 28, 1976

[30] Foreign Application Priority Data

Oct. 4, 1975 [DE] Fed. Rep. of Germany ..... 25445561

[51] Int. Cl.[2] ..... B65H 17/22

[52] U.S. Cl. ..... 226/189; 164/448

[58] Field of Search ..... 226/189, 190, 194, 185; 164/282

[56] References Cited

U.S. PATENT DOCUMENTS

| | | | |
|---|---|---|---|
| 3,753,461 | 8/1973 | Gallucci | 164/282 |
| 3,766,962 | 10/1973 | Rossi | 164/282 X |
| 3,946,798 | 3/1976 | Uchimoto | 164/282 |
| 3,981,348 | 9/1976 | Schmucker | 164/282 X |

*Primary Examiner*—Richard A. Schacher

*Attorney, Agent, or Firm*—Mandeville and Schweitzer

[57] ABSTRACT

The invention covers a supporting roller stand for steel slab strand casting plants, particularly for curved slab strand casting plants with supporting rollers of differential lengths being arranged opposite, in pairs, along the broad sides of the strand profile, subdivided on at least one side over the width of the strand, such supporting rollers being furthermore arranged in groups of differential diameters.

5 Claims, 5 Drawing Figures

SUPPORTING ROLLER STAND FOR STEEL SLAB STRAND CASTING PLANTS, PARTICULARLY FOR CURVED SLAB STRAND CASTING PLANTS

BACKGROUND AND STATEMENT OF THE INVENTION

This type of supporting roller stand serves to support very broad casting strands, i.e. over one meter, e.g. 2100 mm and more, so that bulging of the strand due to ferrostatic pressure in the interior of the strand which is only cooled externally, may be avoided. This type of supporting roller stand requires measurements which will keep within permissible limits any bending of the supporting rollers which are excessively long in accordance with the great width of the strand. Furthermore, it must be insured that the engaging surfaces of the supporting rollers do not inflict any damage on the strand surface such as grooves, tears, or the like.

It was disclosed by German Publication DF-AS No. 1 458 158 to make the diameter of the supporting rollers large enough to withstand ferrostatic pressure with slight bending. However, a large supporting roller diameter results in a wide distance from roller axis to roller axis so that the strand shell may bulge between two supporting rollers. On the other hand, the diameter of the supporting rollers connot be chosen extremely small, either, as this would permit excessive bending of the supporting rollers. The prior art deals with this difficulty by staggering the rollers whereby the end rollers with half the ball or strand engaging surface length are alternately arranged at one axis end each, and each axis is, at its end and between individual rollers, held by axis supports resting on a rear beam. The beams, in turn, rest on a stationary frame. The staggered arrangement of the rollers eliminates grooves in the strand surface as each gap between two supporting rollers on aligned axes is followed by a smooth roller ball or engaging surface of a staggered supporting roller of the neighboring axis which will smooth out already existing grooves, if any. Furthermore this suggestion permits, in view of the rear beam and in conjunction with the stationary frame, to make the diameters of the supporting rollers smaller so that the rollers may be spaced closer together than was previously the case.

The example of the disclosed suggestion shows, however, that the diameters of the supporting rollers are conventionally adapted to the thickness of the strand shell. This results in the familiar group arrangement of the supporting rollers, their diameters increasing from group to group. The increase in the supporting roller diameter by groups serves to increase drive torque which may be applied to a greater degree with increasing thickness of the strand shell. The roller diameter increase by groups further means that in the area where the strand shell is at its thinnest—near the strand casting chill—the diameter of the rollers is small, and where the strand shell is of medium thickness the rollers are provided with medium diameters, and where the strand shell is thick the rollers, too, have the greatest diameters. The known suggestion therefore follows the usual increase in diameter relative to the growing strand shell thickness and cannot make use of the advantage of a bending-resistant supporting roller with greater diameter. This disadvantage is necessarily compensated for by the rear beam in conjunction with the stationary frame.

The present invention is based on the design mentioned initially, e.g. a supporting roller stand with subdivided supporting rollers which are of different lengths and which are arranged in groups of different diameters.

The purpose of the invention is to eliminate bulging of the strand shell in broad slab steel strand casting plants in all solidification areas by using relatively large supporting roller diameters and to simultaneously maintain small distances between rollers, and furthermore to avoid any formation of grooves or similar damages to the surface of the cast strand.

The invention solves this by providing the supporting rollers successively with one smaller and one larger diameter and by arranging next to each supporting roller with large diameter two or more supporting rollers with smaller diameter, on one axis, whereby the combined strand surface engaging length of the supporting rollers with smaller diameter has a greater supporting length than the length of the solid supporting roller with larger diameter. Depending upon the difference in size chosen for the supporting rollers of smaller and larger diameter, provision is made between two supporting rollers of larger diameter for one supporting roller of smaller diameter which avoids any bulging in the area between two supporting rollers arranged at some distance. Supporting rollers of larger diameter may therefore be placed at such intervals that the supporting rollers of smaller diameters including their bearings find room between two supporting rollers of larger diameter.

The invention then avoids the requirement of supporting rollers of large diameter which, given sufficient length, would bend excessively, and also avoids bending of supporting rollers with reduced large diameter. The invention does make it possible to keep a relatively large diameter smaller for economical reasons. The basic concept of the invention does not make it necessary to dimension the supporting rollers with large diameter so that their length is greater than or as great as the width of the cast strand.

The supporting rollers of smaller diameter support the entire width of the cast strand due to the sum of their strand surface engaging lengths on one axis made up of several aligned individual coaxial rollers, whereby the supporting rollers of smaller diameter may even be longer than the width of the cast strand. On the other hand, the supporting rollers of large diameter may be kept shorter, thus eliminating the problem of sagging. The supporting rollers with smaller diameter have two functions. One, they avoid bulging between two supporting rollers with large diameter, and secondly they support areas over the width of the cast strand which are not covered by the supporting rollers with large diameter.

Those areas covered by the supporting rollers of smaller diameter result when, as provided by the invention, the length of the supporting rollers of larger diameter is even with or shorter than the strand width. In case the length of supporting rollers with larger diameter is even with the strand width, the supporting rollers of smaller diameter protrude past the edge of the strand and protect possibly uneven widths of the cast strand.

The principal advantage of the invention, i.e. the shortening of large diameter supporting rollers which are subject to bending stress is particularly useful if the length of the supporting rollers with large diameter decreases with increasing distance from the strand casting chill. This measure is based on the fact that the cast strand's tendency towards bulging decreases as strand shell thickness increases and the purpose of the supporting rollers with large diameter is not so much to support the strand but to transmit traction force to the cast strand. Generally it is advantageous to arrange the supporting rollers of large diameter in the center of the strand width which simultaneously insures symmetrical transmission of extraction forces over the width of the strand.

Furthermore, it is advantageous to provide only supporting rollers of larger diameter with a rotary drive. On one hand, the large supporting roller consisting of one piece is suitable for the transmission of a considerable torque and it requires only one drive. On the other hand the subdivided supporting rollers would require two drives in view of the fact that the motive force is to be transmitted symmetrically to the cast strand. Advantageous is also the central drive effect of the solid supporting rollers due to the greater ferrostatic pressure in the center of the cast strand width as it governs the effect of the drive. In general, it is advisable to synchronize the supporting rollers with larger diameter with the optimum strand width in accordance with the permissible degree of sagging. Furthermore, the invention allows greater length for supporting rollers with larger diameter in the area of liquid strand core than for the same supporting rollers in the area of semi-soft or completely solidified strand core.

Reference is made to the following illustrated embodiments of the invention as applied to a curved slab strand casting plant.

DETAILED DESCRIPTION OF THE INVENTION

Figure 1:
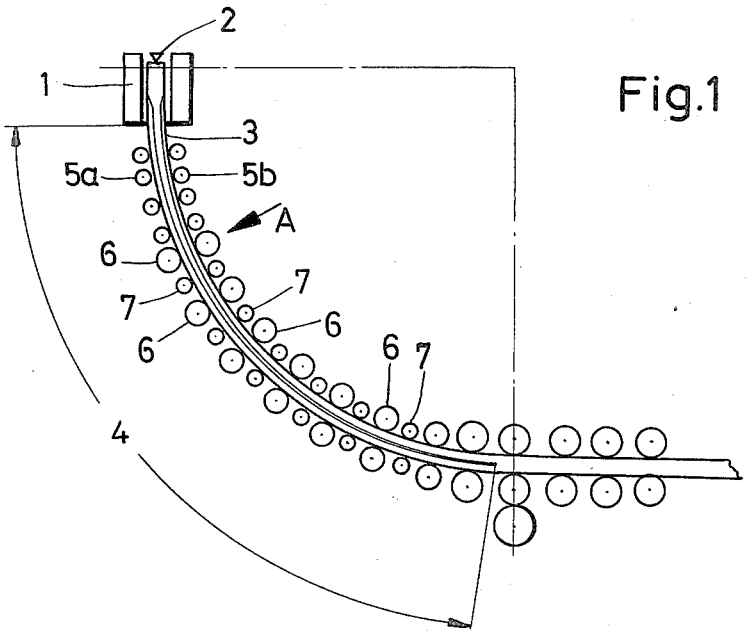
FIG. 1 is a somewhat diagrammatic side elevational view of a slab strand casting plant embodying the invention.

Liquid steel (FIG. 1) is continually poured into strand casting chill 1 containing cooling water. Controlled pouring maintains casting level 2 at the height indicated and cast strand 3 is continually cooled outside the strand casting chill 1 and also transported. In the section or area designated 4 cast strand 3 solidifies up to the core whereby in the area below strand casting chill 1 the majority of the strand interior is still liquid, whereas towards the end of section 4 the cast strand core is liquid/solid or completely hardened depending upon casting velocity, cooling intensity and composition of material. The supporting roller stand as the invention is applied in section 4 where re-crystalization of the liquid steel takes place. Section 4 is of particular importance for the cooling and solidifying process of the steel. The design of the disclosed supporting roller stand has been developed for highly sensitive quality steel cast in the strand casting method. For this type of steel the permissible expansion of the strand shell is below 0.2%.

The means for cooling the cast strand (spray nozzles) have not been incorporated on the drawings for reasons of not obstructing the view. Rotary bearings and mounts for the supporting rollers are also excluded in order to give a clear view of the arrangement of the supporting rollers. Below strand casting chill 1 (FIG. 1) several foot roller pairs 5*a*, 5*b* are provided at close intervals in order to protect the thin strand shell from bulging. These are followed by a supporting roller 6 with larger diameter which in turn is followed by a supporting roller 7 with smaller diameter.

Figure 2:
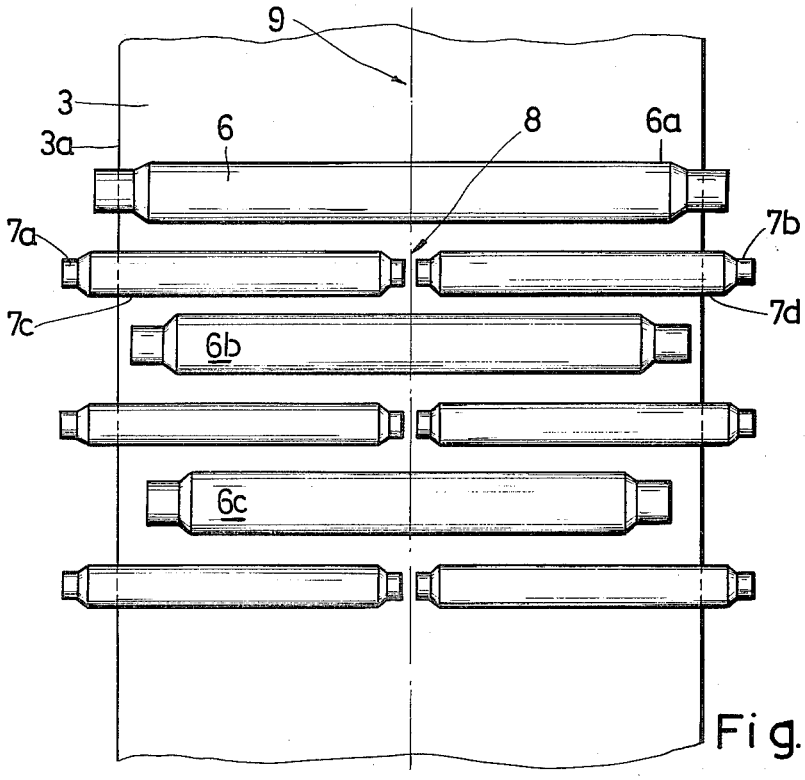
FIG. 2 is an enlarged front elevational view of a portion of the plant of FIG. 1.

Supporting roller 6 (FIG. 2) a strand engaging surface or ball length 6*a* which, in the example shown, does not quite measure the width of cast strand 3 so that edge 3*a* is not supported by supporting roller 6. This support is given by two supporting rollers 7*a*, 7*b* with smaller diameter. Their ball lengths 7*c* and 7*d* (adding the distance of the required rotary bearings 8) are always longer than ball length 6*a*. With increasing thickness of the outer layer, i.e. strand shell of cast strand 3, solidifying under controlled cooling conditions, the risk of bulging is less apparent, whereby it must be considered that edge 3*a* of the cast strand cools faster and becomes harder than the areas left and right of the center 9. The following supporting rollers 6*b* and 6*c* are adapted to their respective strand shell thickness and are therefore shorter. The example shown on drawing 2 is preferably arranged following foot roller pairs 5*a*, 5*b*.

It is to be noted that in the case of vertical slab strand casting plants as well as the curved slab casting plant shown here it is possible to arrange the supporting rollers immediately at the sides of the cast strand section requiring support. It is, however, also possible, particularly with curved and horizontal slab strand casting plants, to provide uniform rollers of a length the same as the width of the strand at the lower side of cast strand section. In that case, the present invention would be applied on top of the cast strand. The arrangement of two supporting rollers 7*a*, 7*b* with smaller diameter and one-piece supporting roller 6 with larger diameter is advantageous at the two opposite strand sides to be supported to keep the water sprayed on for cooling from running off too quickly which is undesirable.

Figure 3:
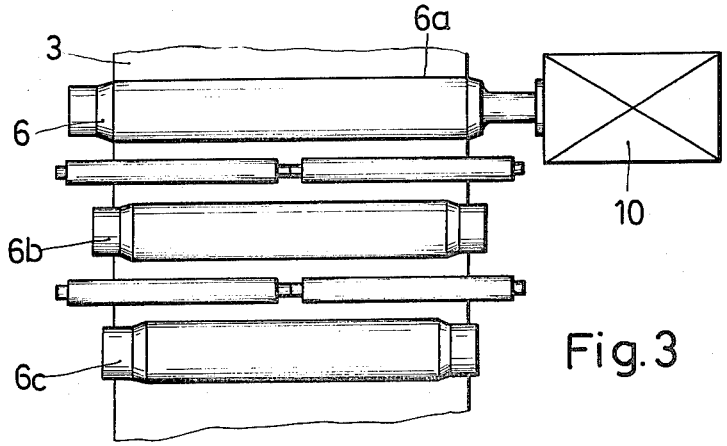
FIGS. 3—5 are enlarged front elevational views of the slab strand casting plant of FIG. 1, illustrating further embodiments of the invention further downstream in the plant.
Figure 4:
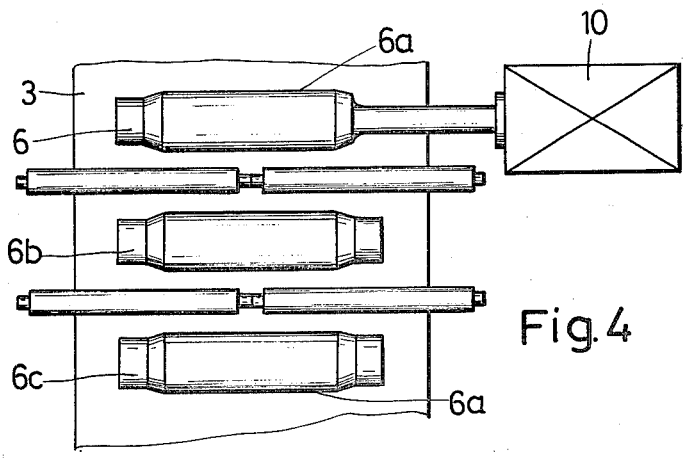
Figure 5:
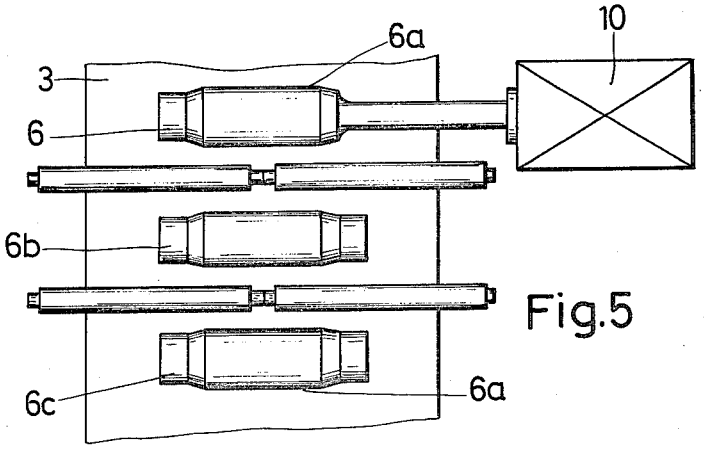

The example according to FIG. 3 provides supporting rollers 6 with larger diameter where ball length 6*a* matches the entire strand width. According to upper supporting roller 6 the graduation in length of the following supporting rollers 6*b*, 6*c* is less pronounced than in the arrangement in FIG. 2. This arrangement results in optimum support of the cast strand whereby cooling of very sensitive steel types progresses somewhat slower. In FIG. 4, shorter ball length 6*a* of supporting rollers 6, 6*b*, 6*c* becomes feasible as soon as the strand shell becomes stronger. Shortening of ball length 6*a* in the area of the mostly solidified strand core is shown on FIG. 5. This arrangement permits generous application of cooling medium to the strand surface without the undesirable quick run-off. One or several of supporting rollers 6, 6*b*, or 6*c* with larger diameter are provided with a rotary drive 10 of the usual construction (FIGS. 3 through 5).

The design examples of FIGS. 2 through 5 teach the basic concept of arranging a supporting roller of smaller diameter between two supporting rollers of larger diameter in order to keep the larger rollers shorter dependent upon the thickness of the solidifying layer of the cast strand. Shorter supporting rollers are less subjected to undesirable sagging. Therefore the invention makes the length of the supporting rollers of large diameter the criteria for the thickness of the already solidified cast strand layer and/or the criteria for the load capacity of the shell surrounding the liquid core, solidifying under the cooling process.

We clam:

1. Roller stand support apparatus for steel slab strand casting plants and particularly curved slab strand casting plant, comprising (a) a plurality of pairs of spaced apart supporting rollers positioned to define a supporting path for a cast strand on each side thereof;

(b) power means connected to at least some of the supporting rollers for driving said rollers;

(c) at least some of said plurality of rollers on at least one side of said path being a plurality of coaxially arranged rollers;

(d) said roller pairs being positioned according to their diameters; the improvement characterized by (e) said supporting rollers being alternately of larger and smaller diameter along the said path;

(f) said smaller diameter rollers being said plurality of coaxially arranged rollers;

(g) the combined length of the supporting surface of each group of coaxially arranged smaller diameter rollers being greater than the length of the supporting surfaces of the said larger diameter rollers, and (h) the length of said supporting surfaces of said larger diameter rollers being equal to or less than the width of the strand supported.

2. The apparatus of claim 1, further characterized by (a) the length of the said supporting surfaces of said larger diameter rollers is less than said supported strand width.

3. The apparatus of claim 2, further characterized by (a) the length of said alternating larger diameter supporting rollers decreases in direct relation along the said supported cast strand length to the distance from the point of casting.

4. The apparatus of claim 2, further characterized by (a) the said supporting surfaces of said larger diameter rollers being centered with said supported strand width.

5. The apparatus of claim 1, further characterized by (a) said power means connected to said larger diameter rollers.

* * * * *